United States Patent [19]

Berlied, Jr.

[11] 4,270,769

[45] * Jun. 2, 1981

[54] SKI BINDING

[76] Inventor: Henry P. Berlied, Jr., Main Street, West Concord, Mass. 01781

[ * ] Notice: The portion of the term of this patent subsequent to Mar. 20, 1996, has been disclaimed.

[21] Appl. No.: 10,708

[22] Filed: Feb. 9, 1979

Related U.S. Application Data

[62] Division of Ser. No. 844,784, Oct. 25, 1977, Pat. No. 4,145,070.

[51] Int. Cl.[3] ..... A63C 9/20

[52] U.S. Cl. ..... 280/615

[58] Field of Search ..... 280/615, 614, 631, 635

[56] References Cited

U.S. PATENT DOCUMENTS

| | | | |
|---|---|---|---|
| 3,481,618 | 12/1969 | With | 280/615 |
| 3,715,127 | 2/1973 | With | 280/615 |
| 3,823,953 | 7/1974 | With | 280/615 |
| 3,920,257 | 11/1975 | Fredriksen | 280/615 |
| 3,945,657 | 3/1976 | Fredriksen | 280/615 |
| 4,109,932 | 8/1978 | With | 280/615 |
| 4,145,070 | 3/1979 | Berlied | 280/615 |

*Primary Examiner*—David M. Mitchell

*Attorney, Agent, or Firm*—Norman S. Blodgett; Gerry A. Blodgett

[57] ABSTRACT

Ski binding for use with cross-country skis, having a stamped sheet metal main plate with integral boot pins and a hinged wire clamping bail.

2 Claims, 6 Drawing Figures

SKI BINDING

This is a division, of application Ser. No. 844,784 filed Oct. 25, 1977 now U.S. Pat. No. 4,145,070.

BACKGROUND OF THE INVENTION

In the design and manufacture of cross-country skis, there are many factors which need to be considered. First and foremost, the binding must be light in weight, because every bit of added weight means added work for the skier on a long cross-country tour. At the same time, the binding must be simple and rugged, because it is subjected to considerable stress and to operation in extremely adverse weather conditions. Complex mechanisms tend to break down under such conditions of use, particularly when the skier is tried and inattentive. Despite these requirements, it is necessary that the binding be inexpensive to manufacture, not only because of the difficulties of marketing and expensive binding, but also because even a high quality binding is in competition with bindings whose manufacturers are not particularly concerned with quality. These and other difficulties experienced with the prior art devices have been obviated in a novel manner by the present invention.

It is, therefore, an outstanding object of the invention to provide a ski binding for use with a cross-country ski which is extremely rugged in construction, so that is will not deteriorate when used under adverse weather conditions.

Another object of this invention is the provision of a cross-country ski binding having a simple structure which is not easily rendered useless, even by a careless skier.

A further object of the instant invention is the provision of a ski binding which is inexpensive to manufacture and which is capable of a long life of useful service with a minimum of maintenance.

It is another object of the instant invention to provide a cross-country ski binding having integral boot pins that do not become loose when subjected to abuse or to corrosion due to chemicals.

A still further object of the invention is the provision of a cross-country ski binding having a clamping bail which cannot become detached from the main plate by accident, but only when a deliberate operation is performed.

It is a further object of the invention to provide a ski binding for use with cross-country skis, wherein the elements associated with the main plate do not leave a space for the accumulation of snow and ice between the plate and the surface of the ski or between the plate and the undersurface of the skier's boot.

With these and other objects in view, as will be apparent to those skilled in the art, the invention resides in the combination of parts set forth in the specification and covered by the claims appended hereto.

SUMMARY OF THE INVENTION

In general, the present invention has to do with a ski binding for attaching the toe of a boot to a cross-country ski. The binding is provided with a sheet metal base plate adapted to be fixed to the horizontal upper surface of the ski, the plate having integral flanges extending vertically on either side for engaging the sides of the boot. A plurality of hollow pins extend vertically upwardly from the bottom of the plate for engagement with suitable apertures in the ski boot, each pin being integrally formed by stamping from the plate. Clampting means is provided in the form of a generally U-shaped wire bail, each leg of the bail being hingedly engaged with one of the side flanges.

More specifically, an upwardly-directed boss is stamped from the base plate and a pin is integrally stamped from the center of the boss, the boss having a flat upper horizontal surface extending outwardly a substantial distance from the pin. The end of each leg of the bail extends through an aperture in its respective flange and is provided with a protuberance on the outside of the flange to inhibit withdrawal. The protuberance is so shaped that the end of the bail cannot be withdrawn through the aperture in the flange unless the bail is deliberately moved to a position that it cannot occupy when the boot is in the binding.

BRIEF DESCRIPTION OF THE DRAWINGS

The character of the invention, however, may be best understood by reference to one of its structural forms, as illustrated by the accompanying drawings, in which.

DESCRIPTION OF THE PREFERRED EMBODIMENT

Figure 1:
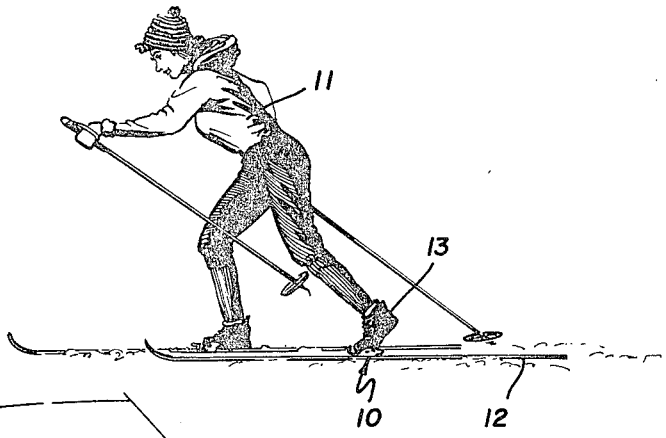
FIG. 1 is a perspective view showing a ski binding in use incorporating the principles of the present invention.

Referring first to FIG. 1, wherein are best shown the general features of the invention, the ski binding, indicated generally by the reference numeral 10, is shown in use by a skier 11, whose boot 13 is held on the upper surface of the ski 12 by the binding.

Figure 2:
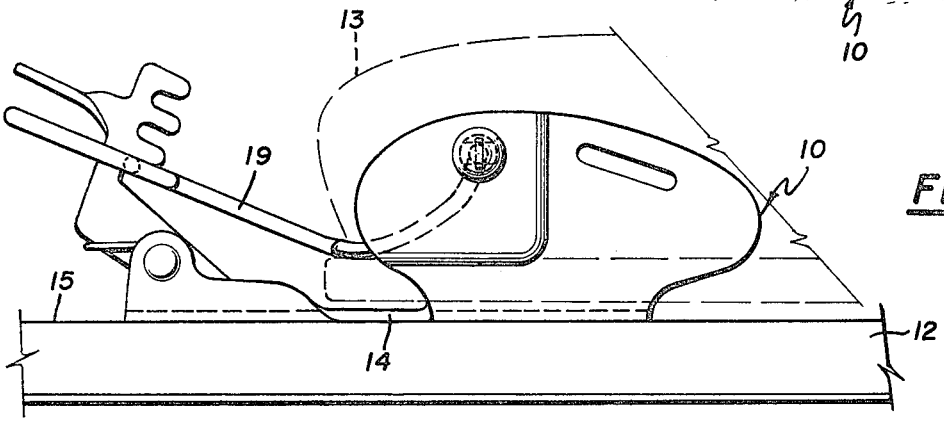
FIG. 2 is a side elevational view of the ski binding.
Figure 3:
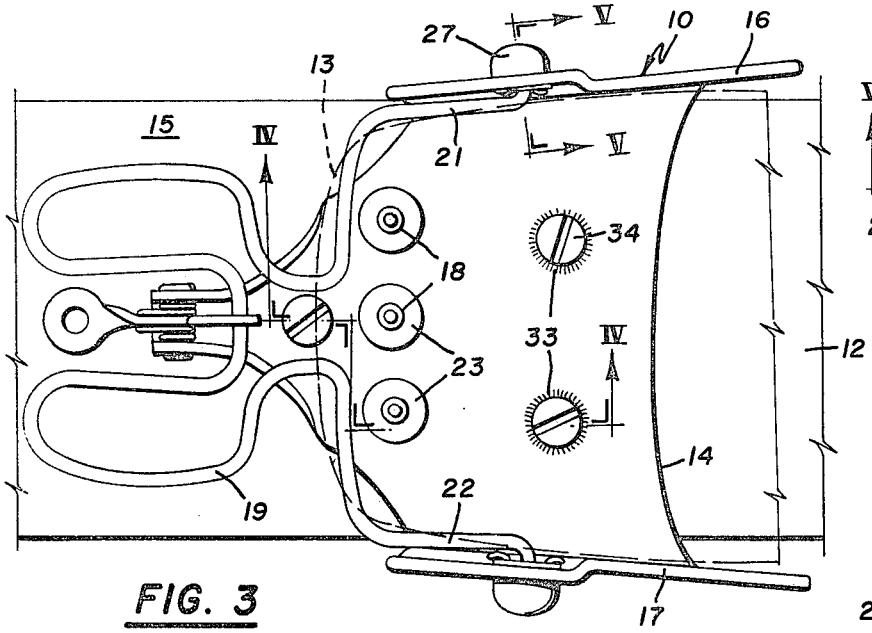
FIG. 3 is a plan view of the binding.

As shown in FIGS. 2 and 3, the binding 10 includes a main base plate 14 fixed to the upper horizontal surface 15 of the ski 12. The plate is formed of sheet metal such as aluminum and is provided with side flanges 16 and 17 extending vertically from either side for engagement with the sides of the boot. A plurality of hollow pins 18 extend vertically-upwardly from the plate for engagement with suitable apertures formed in the bottom of the boot adjacent the toe thereof. Each pin is integrally formed with the plate by stamping it from the plate by use of a staking tool. A clamping means is provided in the form of a generally U-shaped wire bail 19. Each leg 21 and 22 of the bail is hingedly attached to the upper portion of a respective flange 16 and 17.

Figure 4:
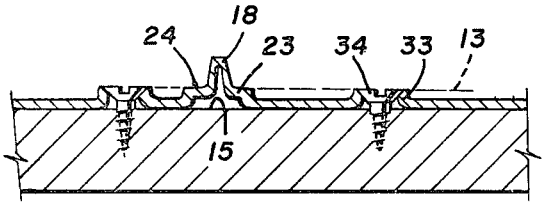
FIG. 4 is a vertical sectional view of the binding taken on the line IV—IV of FIG. 3.

Referring particularly to FIGS. 3 and 4, it can be seen that an upwardly-directed boss 23 is associated with each pin and is stamped at the same time from the base plate. Its pin 18 is integrally stamped from the boss 23 and the boss has a flat upper surface 24 which extends outwardly and horizontally a substantial distance from the pin.

Figure 5:
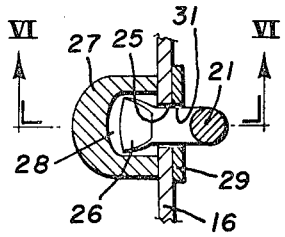
FIG. 5 is a vertical sectional view of the binding taken on the line V—V of FIG. 3.
Figure 6:
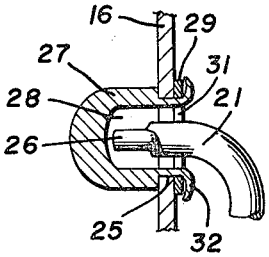
FIG. 6 is a vertical sectional view of the binding taken on the line VI—VI of FIG. 5.

The ends of each of the legs 21 and 22 of the clamping bail extends through an aperture in its flange. For instance, as is shown in FIGS. 5 and 6, the end of the bail 21 extends through an aperture 35 in the flange 16. The extreme end is provided with a protuberance 26 which serves to inhibit withdrawal from the connection to the flange. A cap 27 attached to the outside of each flange overlying the aperture 25 and the cap has a hollow interior 28 which encloses the outer end of the bail and the protuberance 26. A washer 29 lies against the inner surface of the flange 16 and has an aperture 31 through which the bail extends. The cap 27 has integral fingers 32 which extend through the aperture 31 and are swaged over on the outside of the washer to hold it in place. The aperture 31 in the washer is elongated in the horizontal direction (parallel to the upper surface 15 of the ski) and the fingers reside at the ends of the elongated aperture. The protuberance 26 on the end of the bail is formed by upsetting the metal to provide a portion with a cross-section that is elongated in the vertical direction when the bail is in the condition shown in FIG. 2, that is to say, in clamping position. The protuberance is longer than the width of the aperture 31 and shorter than the length with the fingers 32 in place, so that the end of the bail can be withdrawn only when the bail is in a vertical position; that is to say, approximately 90° away from the clamping position.

Referring to FIG. 4, it can be seen that the base plate 14 is provided with a plurality of upwardly-extending integral bosses 33 which are stamped from the material in the bottom of the plate. These bosses are provided with bores which are provided with conical countersinks adapted to receive the conical heads of wood screws 34 which are used for fastening the plates to the upper surface 15 of the ski 12. Because the bosses 33 are stamped upwardly from the sheet metal, not only does no portion of the plate extend below its lower surface, but a small recess is provided around the screw for the introduction of a small amount of sealing compound at the time that the plate is applied to the ski to inhibit entry of water into the wood of the ski.

The operation of the present invention and its advantages will now be readily understood in view of the above description. During assembly the base plate 14 is screwed tightly to the upper surface 15 of the ski. Because the plate has no downwardly-extending protuberances, its undersurface fits tightly against the flat upper surface of the ski. All of the fastening elements, including the bosses 33 and the screws 34, as well as the pins 18 and their bosses 23 are located centrally of the plate, so that the outer periphery of the plate lies in good sealing contact with the surface of the ski and no snow can be introduced there. The skier inserts his boot between the flanges 16 and 17 of the base plate with the apertures in his boot receiving the pins 18. The bail is pressed downwardly in the usual way to clamp the sole of the boot in place. In this condition, as is evident in FIG. 4, the bottom of the boot is supported on the bosses 23 associated with the pins 18 on their upper horizontal surfaces 24. The boot is also supported on the tops of the bosses 33 associated with the fastening screws 34. In this way the boot is supported on discrete "islands" throughout the plate and it is possible to obtain good physical contact with these bosses despite the presence of snow and ice on the binding. Because of the protuberances 26 and the particular alignment of the apertures 31 in the washers, the bail does not easily become disengaged from the remainder of the binding during use. As a matter of fact, it is necessary to deliberately move it into a raised position approximately 90° from clamping position to allow the lengthwise dimension of the protuberances to align with the lengthwise arrangement of the aperture in the washer for removal of the ends of the bail. It is particularly important that it is practically impossible to raise the bail to this removable position while the boot is in place and is being used with the ski. It can be seen that the present structure is very simple in concept and will not be subject to chemical and weather deterioration or to breakage due to use in adverse winter conditions. It is inexpensive to manufacture and, therefore, readily available for use by persons of limited means. Nevertheless, it can be seen that it is possible to produce a ski binding of high quality despite the ease of manufacture. It should be particularly noted that, because the hollow pins 18 are integral with the base, there are no cracks or separating lines giving access to deteriorating chemicals and the like. The binding is particularly free of the possibility of entry of water to the interface between the upper surface 15 of the ski and the under surface of the plate. This is because of the presence of the bosses 23 and the space underlying each of them, along with the fact that no depending protuberances prevent perfect contact between the bottom of the plate and the surface of the ski.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. Cross-country ski binding for fixing the toe of a boot to a ski, comprising:

(a) a sheet metal base adapted to be fixed to the upper horizontal surface of the ski, the plate having integral flanges extending vertically on either side for engaging the sides of the boot, (b) a plurality of hollow pins extending upwardly from the plate for engaging suitable apertures in the boot, each pin being integrally formed from the plate, and (c) a plurality of upwardly-directed bosses, one for each pin, each boss being integrally formed with its respective pin and extending from the base plate, each boss having a flat upper surface below its respective pin and extending outwardly a substantial distance from the pin.

2. Ski binding as recited in claim 1, wherein a plurality of additional upwardly-extending bosses are integrally formed from the plate, each boss having a bore with a conical countersink to receive a wood screw for fastening the plate to the ski, so that the undersurface of the plate has no protuberance for contact with the surface of the ski.

* * * * *